US005236121A

United States Patent [19]

Wollman et al.

[11] Patent Number: 5,236,121

[45] Date of Patent: Aug. 17, 1993

[54] TEXTILE ENVELOPES, CARDS AND THE LIKE AND METHODS OF MANUFACTURE

[76] Inventors: Sandford L. Wollman; Lisa L. Wollman, both of 470 Halstead Ave., Harrison, N.Y. 10528

[21] Appl. No.: 722,874

[22] Filed: Jun. 28, 1991

[51] Int. Cl.[5] ..... B65D 27/02

[52] U.S. Cl. ..... 229/68 R; 229/75; 229/922

[58] Field of Search ..... 229/68 R, 75, 87.18, 229/87.19, , 922, 923

[56] References Cited

U.S. PATENT DOCUMENTS

| | | | |
|---|---|---|---|
| 1,125,683 | 1/1915 | Francis | 229/68 R |
| 1,738,182 | 12/1929 | Goodbar | 229/68 R |
| 2,005,493 | 6/1935 | Blackwell | 229/68 R |
| 3,623,526 | 11/1971 | Robertson | 229/87.01 X |
| 3,743,173 | 7/1973 | Lasker | 229/75 X |
| 4,506,823 | 3/1985 | Büchler | 229/92.8 |
| 4,744,509 | 5/1988 | Büchler-Dopheide | 229/75 X |
| 4,809,904 | 3/1989 | Yasutaniya | 229/68 R |
| 4,948,034 | 8/1990 | Rohloff | 229/70 X |
| 5,004,144 | 4/1991 | Selga | 229/87.19 |
| 5,050,729 | 9/1991 | Karbowniczak | 229/71 X |

FOREIGN PATENT DOCUMENTS

| | | | |
|---|---|---|---|
| 221272 | 9/1924 | United Kingdom | 229/68 |

*Primary Examiner*—Allan N. Shoap
*Assistant Examiner*—Jes F. Pascua
*Attorney, Agent, or Firm*—Steinberg & Raskin

[57] ABSTRACT

A textile envelope comprises front and back panels formed of textile material having substantially the same peripheral shape, a sealing flap formed of textile material joined to a peripheral edge of the front panel, and a stiffener element situated between the front and back textile panels for stiffening at least one of the panels. A method of manufacturing a textile envelope includes the steps of situating a stiffener element between front and back panels formed of textile material, connecting overlying side regions of the front and back textile panels to each other, connecting a top region of the stiffener element to a top region of one of the front and back textile panels, and folding a sealing flap formed of textile material joined to a top edge of the front textile panel over the back textile panel.

17 Claims, 8 Drawing Sheets

FIG. 7a
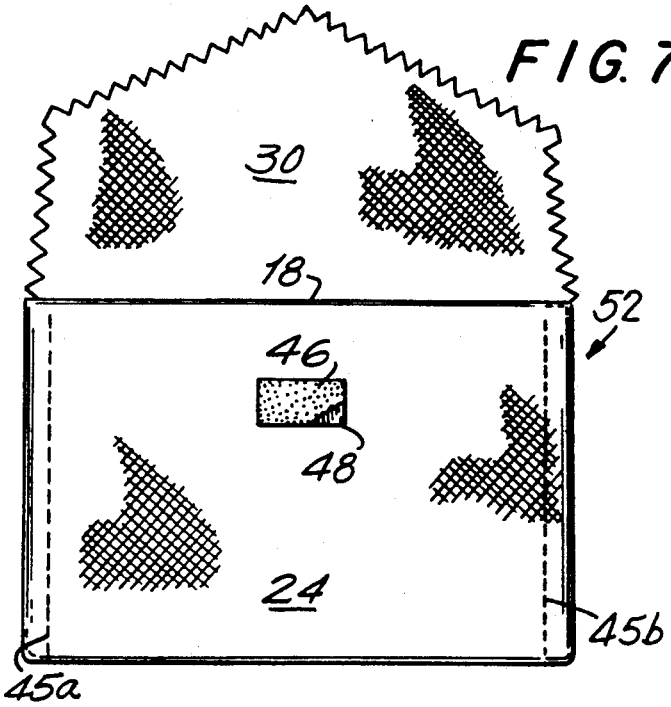
FIG. 7b
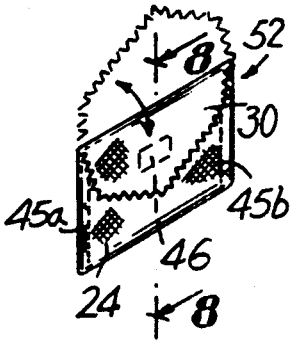
FIG. 8
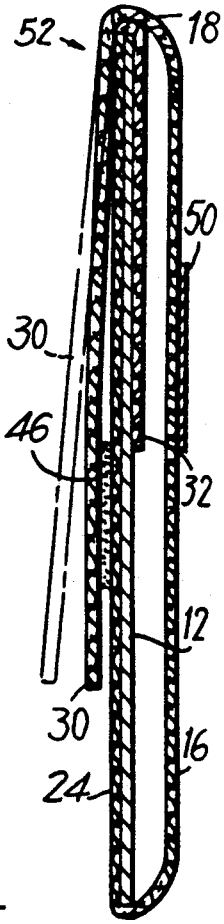
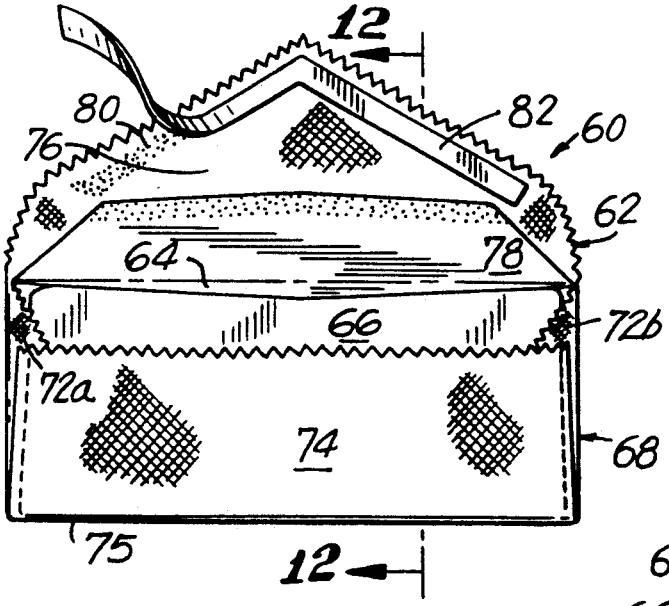
FIG. 11
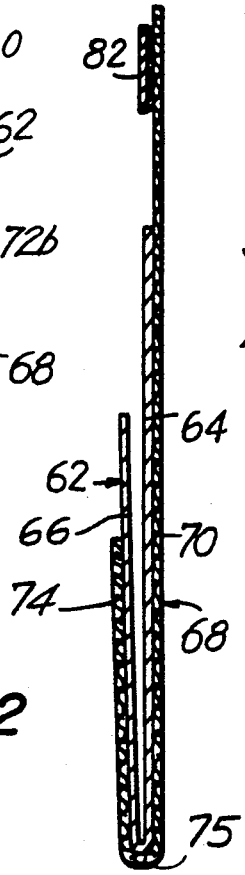
FIG. 12

FIG. 9
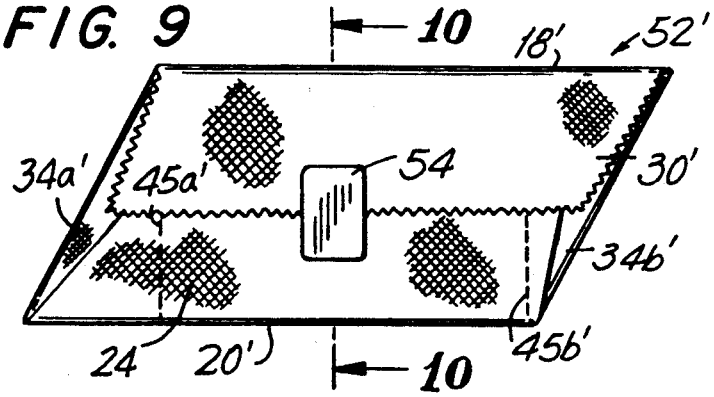
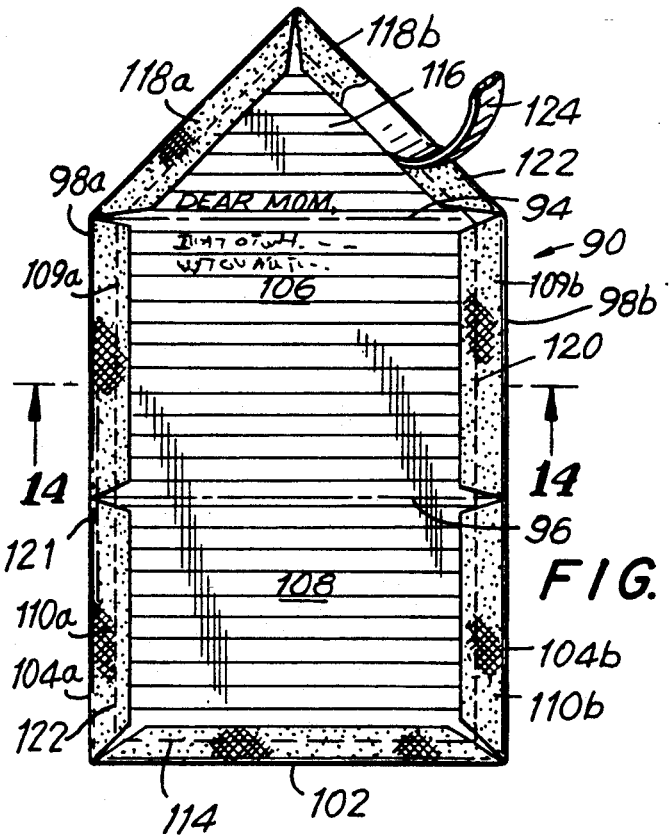
FIG. 13
FIG. 10
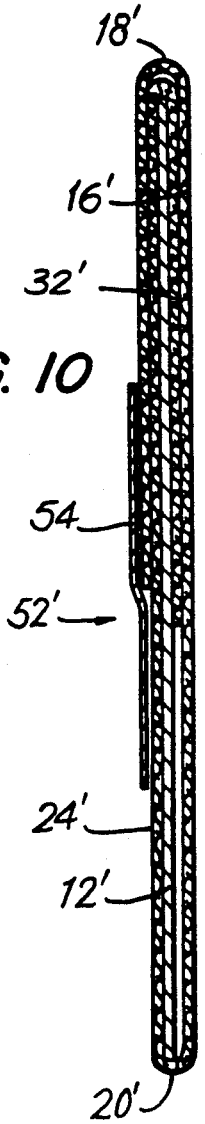
FIG. 14
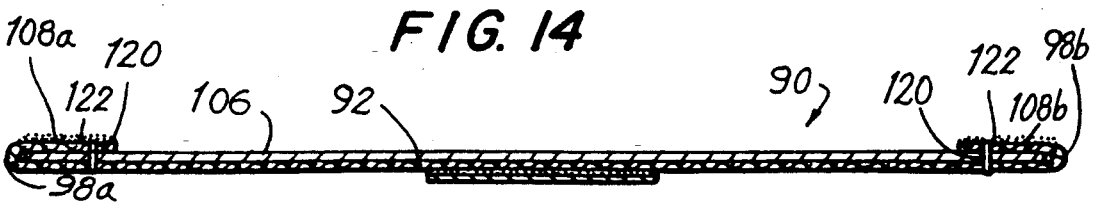

FIG. 15
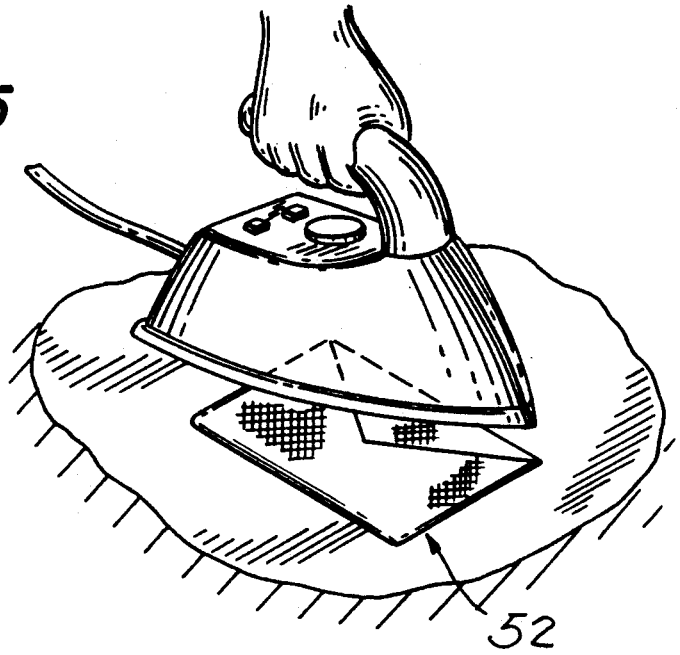
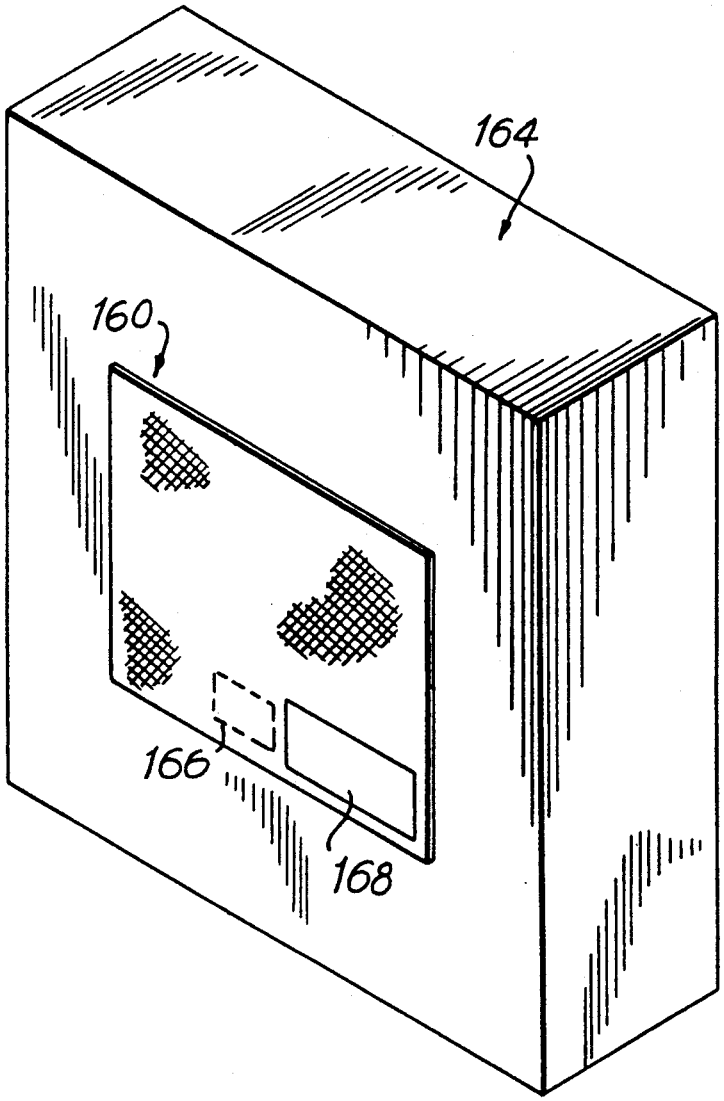
FIG. 25

FIG. 19b
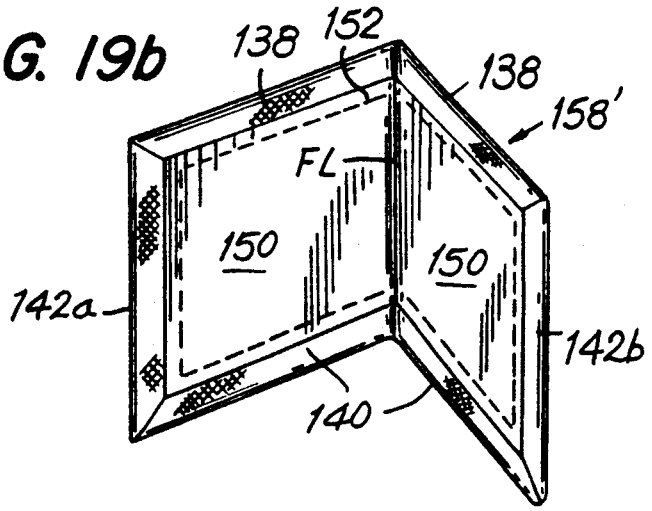
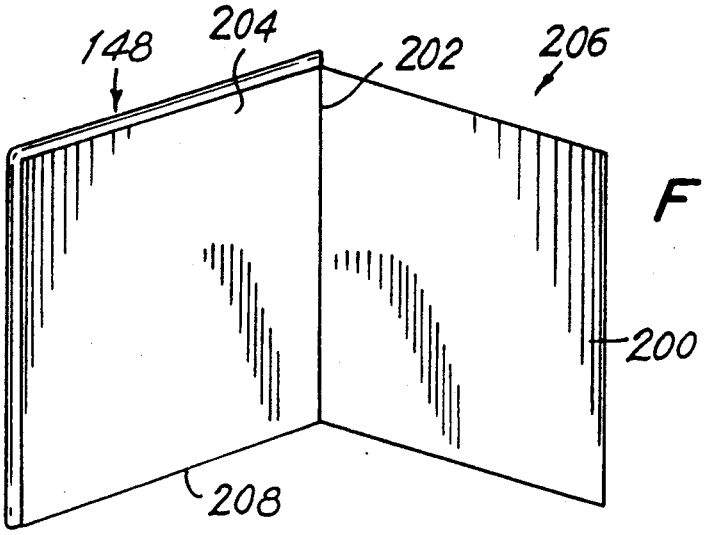
FIG. 24
FIG. 26
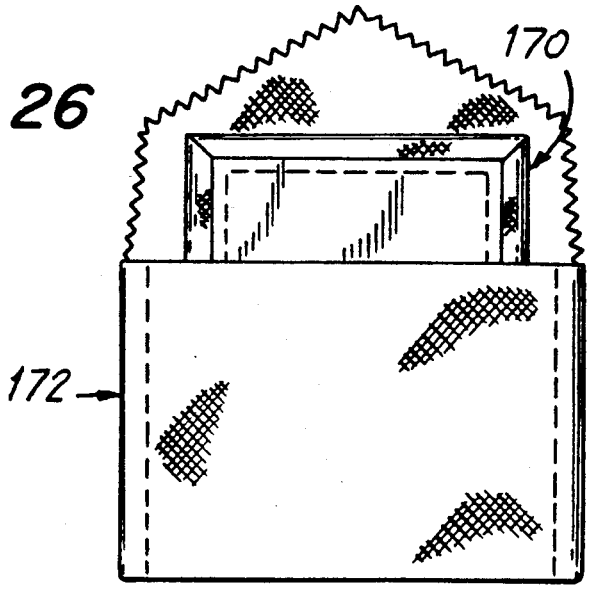

TEXTILE ENVELOPES, CARDS AND THE LIKE AND METHODS OF MANUFACTURE

BACKGROUND OF THE INVENTION

The present invention relates to improvements in envelopes for greeting cards, florist's cards the like, and in general, of the type used when an aesthetically pleasing appearance of an envelope is a concern. The invention also relates to similar improvements in such cards and stationery.

That conventional envelopes of the type used for such things as greeting cards are, in general, made of paper, is a well known fact. It practically need not be mentioned that the characteristics of paper make that material well-suited for envelopes. Paper is light, it can be printed upon, it can be colored, and it provides sufficient rigidity so as to be self-supporting when constructed into an envelope.

It would be desirable, at least from the viewpoint of aesthetics, to use textile material instead of paper in the manufacture of envelopes. As used herein, the term "textile" essentially refers to woven or knitted fabric material made of either natural or man-made fibers, such as cotton and rayon respectively.

In particular, textile material can be made from dyed yarn, to provide the textile with brilliant colors and/or highly detailed designs. Alternatively, textile material can be colored by pulling it through a dyebath, or a dye may be forced into the fabric by means of pressure. A multitude of aesthetic designs can be printed on textile material, such as by means of roller printing, screen printing, or heat transfer printing.

Moreover, a textile material has a desirable "feel" of quality and worth. This property of textiles is determined by the particular fibers used in the manufacture of the textile, and the particular process used in manufacture. For example, cotton fibers produce soft, absorbent fabrics that are used for clothing, sheets and towels. The fibers of the flax plant are made into linen fabric, a strong and smooth fabric. Fabrics made from silk fibers have lustre and softness and can be dyed brilliant colors. Fibers made from wood pulp and linters include rayon and acetate, while fibers made from petrochemicals include nylon and polyester. Rayon produces absorbent fabrics that dye easily. Acetate fabrics resist shrinking and stretching. Nylon fabrics have exceptional strength and wear well. Polyester fabric resists wrinkling. Regarding the processes for manufacturing the fabric, fabrics that are woven with a plain weave are long lasting and have flat texture. Knitted fabrics are more elastic than woven fabrics. Thus, different textiles may be used in the manufacture of an envelope depending upon the particular aesthetic appearance and "feel" that is desired.

However, to date it has not been practical to construct envelopes of textile material because textiles are generally limp and not self-supporting. An envelope should possess a certain degree of rigidity, and should be self-supporting, to facilitate handling as well as the insertion into and removal from the envelope of its contents. Textile materials do not generally possess such characteristics, and have therefore not been used heretofore in the construction of envelopes.

Similarly, greeting cards and stationery are in general made of paper since paper can be printed or written upon and has sufficient rigidity, especially when folded upon itself, to be self-supporting. On the other hand, textile materials cannot be easily written upon and are generally not self-supporting, and for these reasons have not been used in the manufacture of cards and stationery.

SUMMARY OF THE INVENTION

Accordingly, one object of the present invention is to provide new and improved envelopes, cards and the like, made of textile, i.e., woven or knitted fabric, material.

Another object of the present invention is to provide new and improved methods for making envelopes, cards and the like, of textile material.

Still another object of the present invention is to provide new and improved envelopes, cards and the like, that have an aesthetically pleasing appearance and feel.

A further object of the present invention is to provide new and improved cards and the like, substantially formed of textile material, which are suited for use with either textile envelopes in accordance with the invention, or with conventional paper envelopes.

Briefly, these and other objects are attained in accordance with the invention by providing several different embodiments of envelopes made of textile material and methods for making them. In one embodiment, the textile envelope comprises front and back panels formed of textile material having substantially the same peripheral shape and respective peripheral regions in opposed relationship with, and connected to, each other. A sealing flap formed of textile material is joined to a peripheral edge of the front panel defining a closure for an open end of the envelope, and means are situated between and affixed to at least one of the front and back textile panels for stiffening at least one of them.

The stiffening means preferably comprises a planar stiffener element formed of any suitable self-supporting material, such as card material, having a peripheral shape which is substantially the same as the peripheral shape of the front and back textile panels. The card material is preferably manufactured from recycled paper products.

In accordance with a method of the invention, a textile envelope is made by situating a stiffener element between front and back panels formed of textile material, the textile panels and stiffener element having substantially the same peripheral shape, connecting overlying peripheral side regions of the front and back textile panels to each other, connecting a top region of the stiffener element to a top region of one of the front and back textile panels, and folding a sealing flap formed of textile material which is joined to a top edge of the front textile panel over the back textile panel.

Although the textile panels may be formed from separate pieces of textile material, it is preferred that they each comprise a part of a single unitary piece or blank of textile material.

According to another embodiment, a textile envelope in accordance with the invention includes an inner paper envelope comprising inner front and back panels made of paper material, and an outer textile envelope comprising an outer front panel made of textile material situated over the inner front paper panel, a pair of side flaps formed of textile material joined to side edges of the outer front textile panel folded over and affixed to peripheral side regions of the inner back paper panel, and an outer back panel formed of textile material joined to a bottom edge of the outer front textile panel and folded over and affixed to the inner back paper panel and the side flaps which have been folded over and affixed thereto. In this embodiment, the inner paper envelope essentially constitutes a stiffener element situated between the front and back textile panels of the outer envelope.

A third embodiment of a textile envelope comprises a front panel formed of textile material, a back panel formed of textile material, a closure flap formed of textile material joined to the top edge of the front panel, and means connected to the front and back textile panels for both stiffening the panels and for providing a writing surface.

A textile card especially suited for insertion into a textile envelope in accordance with the invention, as well as into conventional paper envelopes, comprises a panel formed of textile material, first means connected to the textile panel for stiffening the same, and second means connected to at least one of the textile panel and the stiffening means for providing a printing surface for indicia. The card may be folded in half to obtain the familiar "booklet" appearance. Alternatively, the second means may comprise a first paper panel which overlies and is connected to the textile panel and/or the stiffening means, and a second paper panel which is joined to the first at a fold line, and projects beyond the textile panel.

DESCRIPTION OF THE DRAWINGS

A more complete appreciation of the present invention and many of the attendant advantages thereof will be readily understood by reference to the following detailed description when considered in connection with the accompanying drawings in which:

FIG. 7*a* is a rear elevation view of a textile envelope in accordance with the invention made from the textile blank and stiffener element of FIGS. 1*a* and 1*b*, according to the steps shown in FIGS. 2–6;

FIG. 7*b* is a perspective view of the textile envelope of FIG. 7*a* showing the open and closed positions of the sealing flap;

FIG. 8 is a section view taken along line 8—8 of FIG. 7;

FIG. 9 is a rear elevation view of a modification of the embodiment of a textile envelope of the type shown in FIGS. 7*a* and 7*b;*

FIG. 10 is a section view taken along line 10—10 of FIG. 9;

FIG. 11 is a rear elevation view of a second embodiment of a textile envelope in accordance with the invention;

FIG. 12 is a section view taken along line 12—12 of FIG. 11;

FIG. 13 is a plan view of a third embodiment of a textile envelope in accordance with the invention, shown in an open position;

FIG. 14 is a section view taken along line 14—14 of FIG. 13;

FIG. 15 is a perspective view of a pressing step in the method of manufacture of a textile envelope in accordance with the invention;

FIG. 19*b* is a perspective view of a modification of the embodiment of a textile card shown in FIG. 19*a* which is folded into booklet form;

FIG. 24 is a perspective view of another embodiment of a textile card in accordance with the invention having a booklet form;

FIG. 25 is a perspective view showing an application for a textile envelope in accordance with the invention; and FIG. 26 is a rear elevation view of a textile card in accordance with the invention being inserted into, or withdrawn from, a textile envelope in accordance with the invention.

DETAILED DESCRIPTION OF THE PREFERRED EMBODIMENTS

Figure 1A:
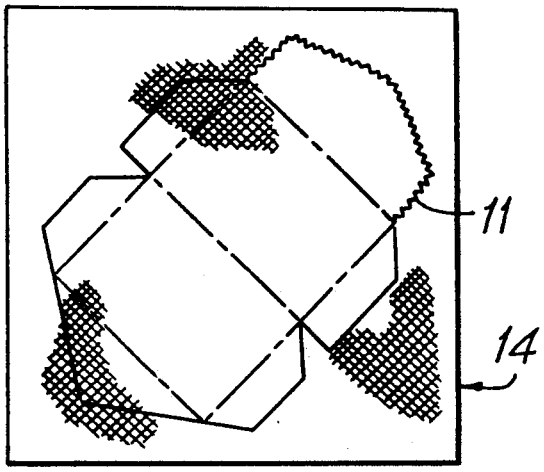
FIG. 1*a* is a plan view of a piece of textile material showing the outline of a blank to be cut therefrom for use in making a textile envelope in accordance with the invention.
Figure 1B:
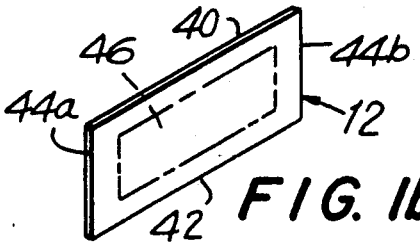
FIG. 1*b* is a perspective view of a stiffener element for use in the manufacture of a textile envelope in accordance with the invention.
Figure 2:
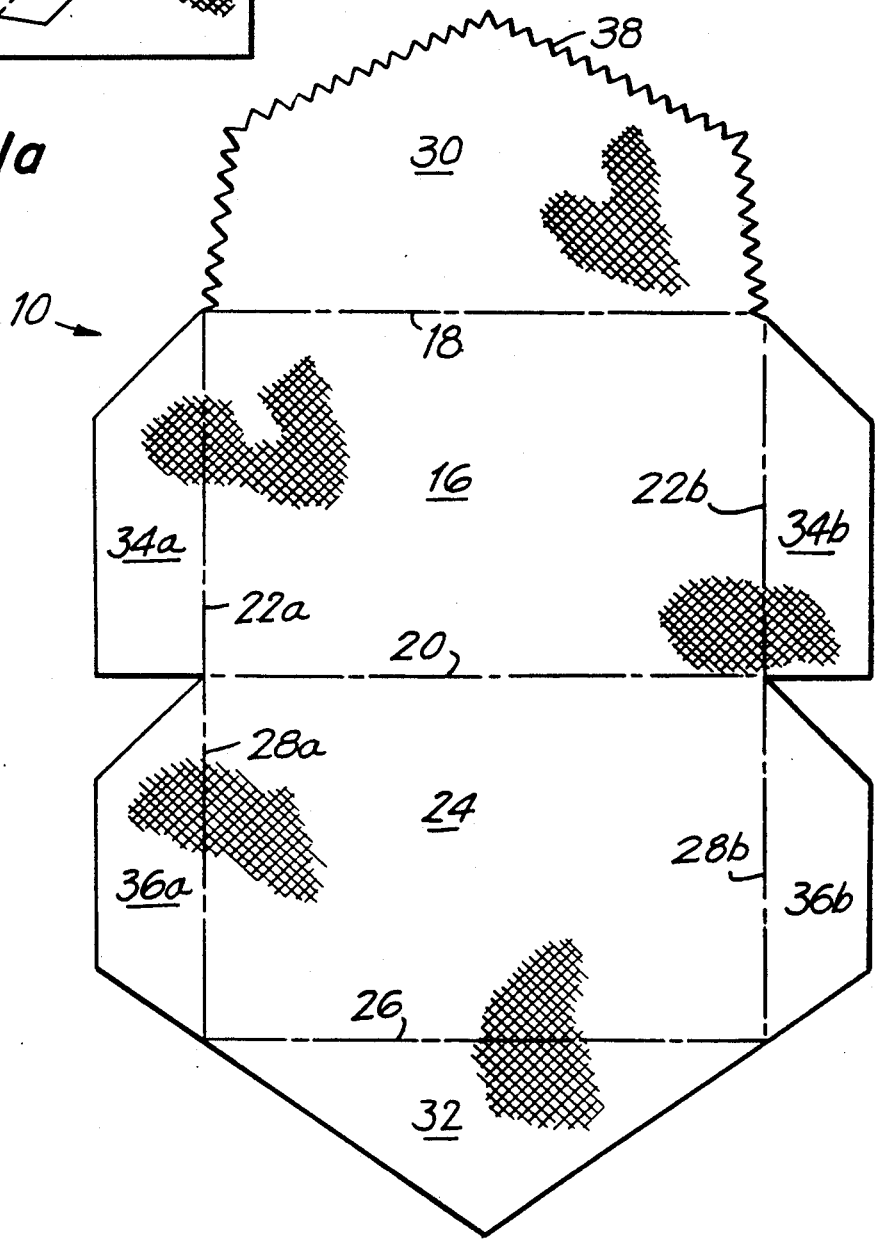
FIG. 2 is a plan view of a blank formed of textile material which has been cut from the piece of textile material shown in FIG. 1*a;*

Referring now to the drawings wherein like reference characters designate identical or corresponding parts throughout the several views, and more particularly to FIGS. 1*a*, 1*b* and 2, an envelope in accordance with the invention is constructed from a blank 10 of textile material and a stiffener element 12 (FIG. 1*b*). The blank 10 is cut from a piece of textile fabric 14 (FIG. 1*a*) on which the pattern 11 for the blank 10 has been marked. Although die cutting of the textile piece 14 is preferred for manufacture in production quantities, several blanks may be cut at one time from a stack of corresponding pieces 14 of textile fabric using a sharp pair of scissors. Of course, other means may be used to cut the blank from a textile piece, including laser cutting, slitting, etc. In the illustrated embodiment, the piece of textile 14 comprises a woven cotton fabric.

Referring to FIG. 2, the textile blank 10 includes a rectangular front panel 16 having top and bottom edges 18 and 20, and side edges 22a, 22b. A back textile panel 24 having substantially the same shape as front panel 16 is joined to the front panel 16 at the bottom edge 20 thereof, which also constitutes the bottom edge of back panel 24. The periphery of back panel 24 is also defined by a top edge 26 and side edges 28a, 28b. A textile sealing flap 30 is joined to front panel 16 at its top edge 18 and a tuck flap 32 is joined to the back panel 24 at its top edge 26. A pair of first textile side flaps 34a, 34b are joined to the front panel 16 at side edges 22a and 22b respectively, and a pair of second textile side flaps 36a, 36b are joined to the back panel 24 at side edges 28a and 28b thereof. The outer edges 38 of sealing flap 30 are preferably "pinked" as shown.

The stiffener element 12 comprises a substantially planar piece of relatively rigid material having a peripheral shape which is substantially the same as the peripheral shape of the front and back textile panels 16 and 24. In the illustrated embodiment, the stiffener element comprises a rectangular piece of card material of 8 mils thickness having top and bottom edges 40 and 42, and side edges 44a and 44b. The lengths of the top and bottom edges 40 and 42 of stiffener element 12 is substantially the same as the lengths of the top and bottom edges 18, 20 and 26, 20 of front and back panels 16 and 24, while the lengths of the side edges 44a and 44b of the stiffener element 12 is about the same as the lengths of the side edges 22a, 22b and 28a, 28b of front and back panels 16 and 24. The card material of stiffener element 12 is preferably obtained from recycled paper products.

Although the stiffener element shown in FIG. 1b comprises a continuous piece of card material, it is understood that it is the shape of the periphery of the stiffener element that is important so that, for example, the stiffener element 12 can be formed with a central opening 46, shown in phantom in FIG. 1b, in which case the stiffener element comprises a rectangular frame-like element. The planar stiffener element can be formed of any substantially rigid material, such as plastic or metallic sheet material (or may comprise a conventional paper envelope as described below in connection with FIGS. 11 and 12).

Figure 3:
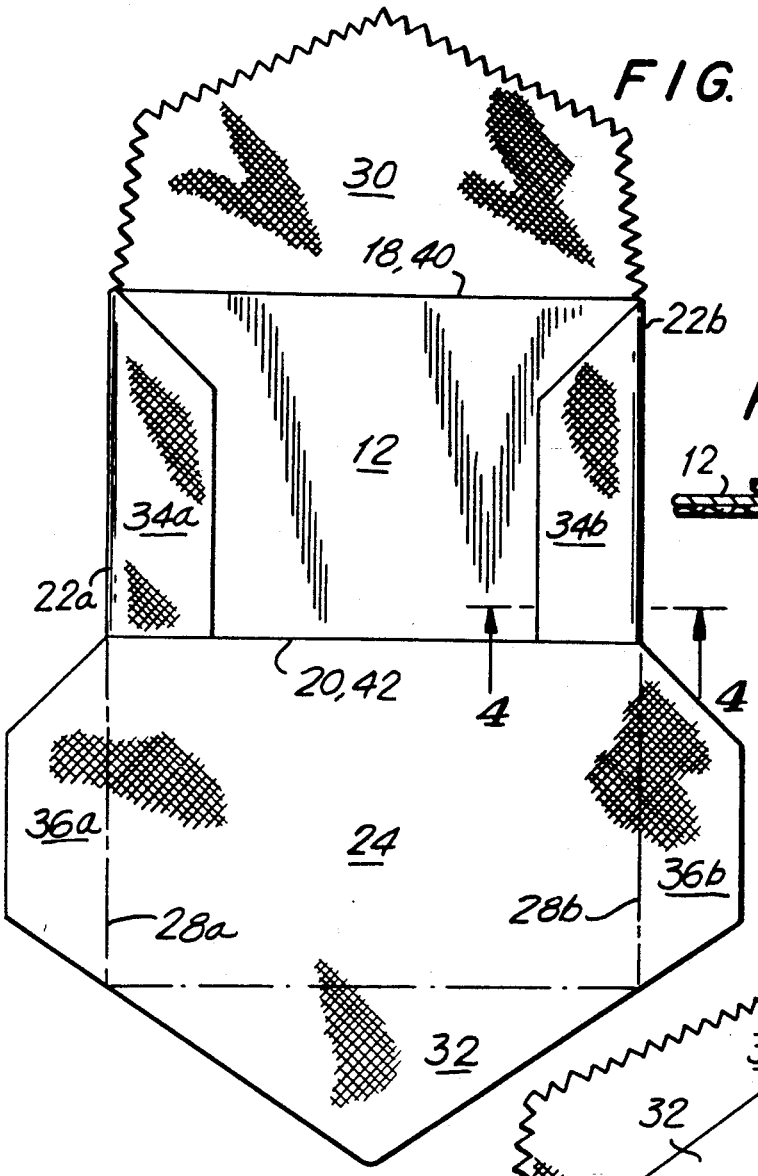
FIG. 3 is a plan view of the textile blank of FIG. 2 in association with the stiffener element of FIG. 1*b* during the manufacture of a textile envelope.
Figure 4:
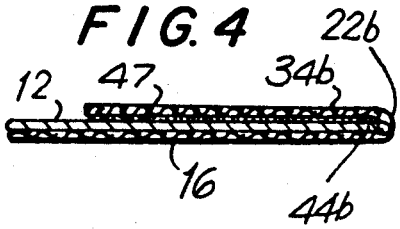
FIG. 4 is a section view taken along line 4—4 of FIG. 3.

Referring now to FIGS. 3 and 4, in constructing a textile envelope in accordance with the invention, the stiffener element 12 is initially situated on the front textile panel 16 so that the top, bottom and side regions of the stiffener element, i.e. the peripheral regions of the stiffener element adjacent to its respective top, bottom and side edges 40, 42, 44a and 44b, overlie the corresponding top, bottom and side regions of the front panel 16. With the stiffener element 12 so situated, the first side flaps 34a and 34b are folded over the side edges 44a and 44b of the stiffener element 12 to overlie the corresponding side regions thereof. The flaps are glued to the stiffener element at 47 (FIG. 4) in order to hold the stiffener element 12 in place during subsequent manufacturing steps described below. A stick-type glue available under the trademark Pritt is preferred for this purpose. Of course, other means for affixing the flaps 34a and 34b to the stiffener element 12 can be used, such as transfer tape, hot melt adhesives, ultrasonics, etc.

In the next step of manufacture, the second textile side flaps 36a, 36b are folded at the respective side edges 28a and 28b at which they are joined to the back textile panel 24 to overlie the side regions of the back panel 24. With the second side flaps so folded, back panel 24 is folded at the common bottom edge 20 of the front and back panels so that respective peripheral edge regions of the back panel 24 overlie corresponding respective peripheral edge regions of the stiffener element 12 and front panel 16. The respective side regions of the front and back textile panels 16 and 24, and the side regions of the stiffener element 12 situated between them, are then connected to each other by stitching, designated 45a and 45b, although other connecting techniques may be used, such as embroidering, stapling, ultrasonics, adhesives, etc.

Figure 5:
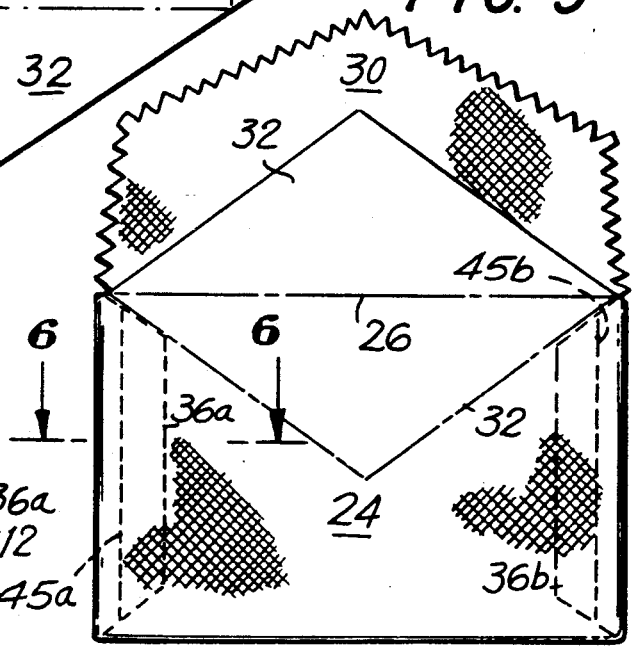
FIG. 5 is a plan view of the textile blank in a subsequent stage of manufacture of a textile envelope.
Figure 6:
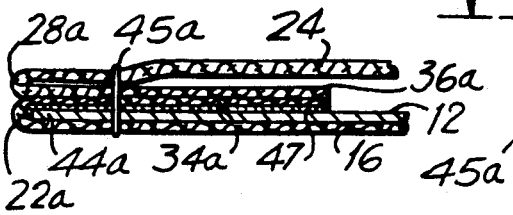
FIG. 6 is a section view taken along line 6—6 of FIG. 5.
Figure 16:
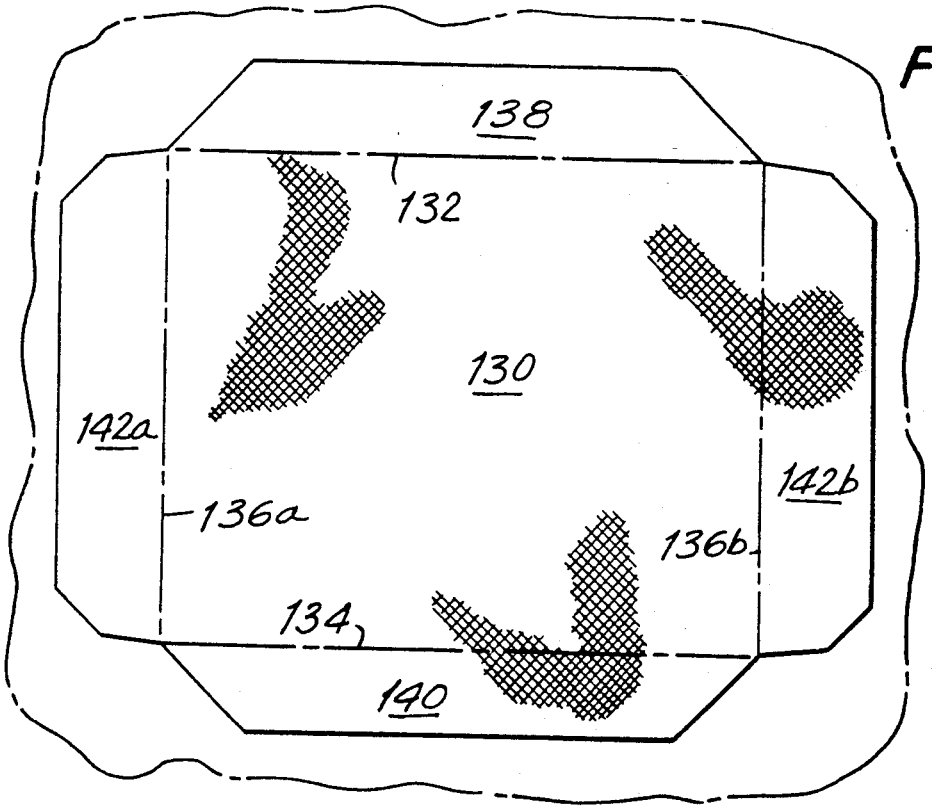
FIG. 16 is a plan view of a blank formed of textile material for use in making a textile card in accordance with the invention.

Referring to FIG. 5, after the stitching of the side regions has been completed, the tuck flap 32 is in the position shown by the solid lines in FIG. 5. Glue is applied to the surface of the tuck flap 32 which faces the sealing flap 30 whereupon the tuck flap 32 is folded over the top edge 40 of the stiffener element 12 and affixed to the top region of the stiffener element 12 in the position shown in phantom in FIG. 5. In this manner, the top region of the stiffener element 12 is connected to the top region of the back panel 24.

Referring now to FIGS. 7a, 7b and 8, the construction of the envelope is completed by applying a layer of pressure sensitive adhesive 46 to the surface of the back panel 24 at a region where the sealing flap 30 will engage it when it is closed to seal the envelope. The adhesive layer 46 may be provided in the form of double-sided transfer tape. A removable protective cover sheet 48 may be provided over the adhesive layer 46. At the same time, one or more pressure sensitive adhesive labels 50 (FIG. 8) may be applied to the front panel 16 to provide a writing surface. For example, a pre-cut label available from Dennison Corp. under the trademark Presaply is satisfactory.

The sealing flap 30, with an adhesive protective sheet covering adhesive 46, is then folded with respect to the top edge 18 of front panel 16 to overlie the back panel 24. At this stage the completed envelope 52 is situated on a flat surface and "ironed", i.e., subjected to heat and uniform pressure, as seen in FIG. 15. The envelope is turned over and the pressing is repeated. In this manner the adhesive 46 of the sealing flap 30, and the adhesive of the label or labels 50, is fused into the weave of the textile material. At the same time, a crease is permanently formed along the fold line 18, which functions as hinge means for connecting the sealing flap 30 to the front panel 16 of the envelope 52.

Referring to FIGS. 7 and 8, the envelope 52 as formed comprises front and back panels 16 and 24 formed of textile material having substantially the same peripheral shape and having respective peripheral regions in opposed relationship with, and connected to, each other. The sealing flap 30 formed of textile material joined to the top edge of the front panel by hinge means 18 defines a closure for the open end of the envelope. The stiffener element 12, having substantially the same peripheral shape as the front and back textile panels, is situated between the front and back textile panels 16 and 24, and the side regions of the front and back panels, and of the stiffener element situated between them, are connected to each other by stitching 45a, 45b or other equivalent means. At the same time, the top region of the back textile panel is connected to the top region of the stiffener element by affixing the tuck flap 32 to the top region of the stiffener element.

The connection on the one hand of the side regions of the stiffener element 12 to at least the side regions of the front panel 16 and, on the other hand, the connection of the top region of the stiffener element to the top region of the back panel, enables the stiffener element to rigidify or stiffen the envelope 52, so that the envelope is self-supporting despite the fact that it is formed of textile material.

The textile envelope 52 is rectangular by virtue of the peripheral shapes of the front and back panels and stiffener element being rectangular. However, textile envelopes having peripheral shapes other than rectangular can be manufactured in accordance with the invention. For example, referring to FIGS. 9 and 10 in which parts that correspond to similar parts of the envelope 52 of FIGS. 1–8 are designated by the same reference numerals primed, the envelope 52' has the shape of a rhomboid. Other shapes are possible within the scope of the invention, such as trapezoidal. In the envelope 52' shown in FIGS. 9 and 10, the front and back textile panels 16' and 24', and stiffener element 12' situated between them, have substantially the same peripheral shape, namely, a rhomboid. It is noted that in the envelope 52', structure analogous to the second side flaps 36*a* and 36*b* of the envelope 52 of FIGS. 1–8 is omitted, and the first side flaps 34*a'* and 34*b'* are glued to stiffener element 12' to close the sides of the envelope 52'. It should also be noted that the back panel 24' and front panel 16' will essentially comprise "mirror images" of each other on the textile blank (not shown) with respect to their common bottom edge 20'. Instead of a layer of adhesive, such as 46 in the embodiment of FIGS. 7 and 8, the sealing flap 30' is connectable to the back panel 24' by means of an adhesive sticker 54 which overlaps both the sealing flap and the back panel 24'. Stitching 45*a'* and 45*b'* interconnects the front and back panels and the stiffener element between them. It is noted that the stitching lines extend substantially at right angles to the top and bottom edges 18' and 20' of the envelope to define a substantially rectangular compartment therewithin.

Referring now to FIGS. 11 and 12, another embodiment of a textile envelope, generally designated 60, is illustrated. Textile envelope 60 comprises an inner paper envelope 62 including inner front and back panels 64, 66 made of paper material having respective aligned side and bottom regions (not shown) connected to each other. An outer textile envelope 68 includes an outer front panel 70 formed of textile material situated over the inner front paper panel 64, a pair of side flaps 72*a* and 72*b* formed of textile material joined to the side edges of the outer front textile panel, and an outer back panel 74 formed of textile material joined to a bottom edge 75 of the outer front textile material 70. The side flaps 72*a* and 72*b* are folded over and affixed, such as by glue, to the side regions of the inner back paper panel 66 of the inner paper envelope 62. The outer back panel 74 which is somewhat shorter than the outer front panel although having substantially the same peripheral shape, is folded over the bottom edge of the inner paper envelope and affixed, such as by glue, to at least the top region of the inner back paper panel 66 and to the side flaps 72*a* and 72*b* that are folded over thereto. The outer textile envelope also includes a sealing flap 76 formed of textile material joined to a top edge of the outer front textile panel 70. The inner paper envelope is also provided with a sealing flap 78 joined to the top edge of the inner front panel 64. Strips of transfer tape 80 provided with a protective covering 82 are provided on the outer sealing flap 76.

In the construction of the textile envelope 60 shown in FIGS. 11 and 12, the inner paper envelope 62 in essence constitutes a stiffener element similar in function to the stiffener element 12 of the embodiment of FIGS. 1–8. In this modification, however, the stiffener element itself defines the envelope compartment. Thus, envelope 52' comprises front and back panels 70, 74 formed of textile material having substantially the same peripheral shape, and having bottom and side regions in opposed relationship, and connected to each other. The inner paper envelope, or "stiffener element", 62, having substantially the same peripheral shape as the front and back textile panels, is situated between them, and the side regions of the front textile panel are connected to the side regions of the inner paper envelope or stiffener element by side flaps 72*a*, 72*b*. The top region of the back textile panel 74 is connected to the top region of the paper envelope.

Referring now to FIGS. 13 and 14, another embodiment of a textile envelope in accordance with the invention, generally designated 90, is shown. The envelope 90 comprises a front panel 92 formed of textile material having top and bottom edges 94 and 96, and side edges 98*a* and 98*b*. A back panel (not shown) formed of textile material has a top edge 102, side edges 104*a* and 104*b*, and a bottom edge 96 common with the front panel 92 to which it is joined. A sealing flap formed of textile material is joined to the top edge 94 of the front panel 92.

A first panel 106 formed of paper material is connected to the front textile panel 92 and a second panel 108 formed of paper material is connected to the back textile panel. In the illustrated embodiment, the first and second paper panels are formed of a unitary sheet of paper material. The first paper panel 106 is connected to the front textile panel by first side flaps 109*a* and 109*b* of textile material joined at the side edges 98*a* and 98*b* of the front panel which are folded to overlie, and then are affixed to, the side regions of the first paper panel 106. Similarly, second side flaps 110*a* and 110*b* of textile material joined to the side edges 104*a* and 104*b* of the back panel are folded to overlie and be affixed to the side regions of the second paper panel 108. A bottom flap 114 of textile material is folded to overlie and be affixed to a bottom region of the second paper panel 108.

In the illustrated embodiment, a third paper panel 116 is connected to the textile sealing flap which is joined to the top edge 94 of the front textile panel 92. The third paper panel 116 comprises a part of the unitary sheet of paper defining the first and second paper panels 106 and 108. Third side flaps 118*a*, 118*b* joined to the sealing flap are folded over the side regions of the third paper panel 116.

A line of stitching 120 extends around the entire peripheral region of the envelope 90 connecting the peripheral edge regions of the textile panels and sealing flap to the respective peripheral edge regions of the paper panels and to the first, second and third side flaps which overlie them.

The paper panels have a dual function in the envelope 90. In particular, when the envelope 90 is closed, the bottom panel is folded over the top panel with respect to the common bottom edge 96, whereupon the sealing flap is folded with respect to the top edge 94 of the front panel to overlie the bottom panel. In this closed configuration, the first and second paper panels 106, 108 together function as a "stiffener element" situated between the front and back textile panels having side and top regions connected to side and top regions of the textile panels. Additionally, the first and second paper panels 106, 108 provide a writing surface. A layer of adhesive 122 is provided on the exterior surface of the side flaps, preferably covered by a removable protective layer 124 for affixing the sealing flap to the back textile panel.

In a modification of the embodiment shown in FIGS. 13 and 14, an additional paper panel may be affixed over one or both of the first and second paper panels 106, 108 to provide the writing surface, in which case the underlying first and second paper panels 106, 108 function only as a stiffener element. For example, a sheet of paper, a part of an edge of which, designated 121, is shown in phantom in FIG. 13, may be affixed to the assembly so that first and second portions thereof overlie the first and second paper panels 106, 108 and folded flaps 109, 110 respectively. In this modification, the material of the first and second paper panels may be chosen solely with a view toward providing a stiffening function.

Referring now to FIGS. 16–23, a textile note card is provided which may be used in conjunction with a textile envelope in accordance with the invention, or which may be used alone or with conventional paper envelopes.

In construction, panel 130 formed of textile material has a rectangular peripheral shape and is bordered by top and bottom edges 132 and 134, and side edges 136*a* and 136*b*. Top and bottom flaps 138 and 140, and side flaps 142*a* and 142*b* are joined to respective edges of panel 130.

Figure 17:
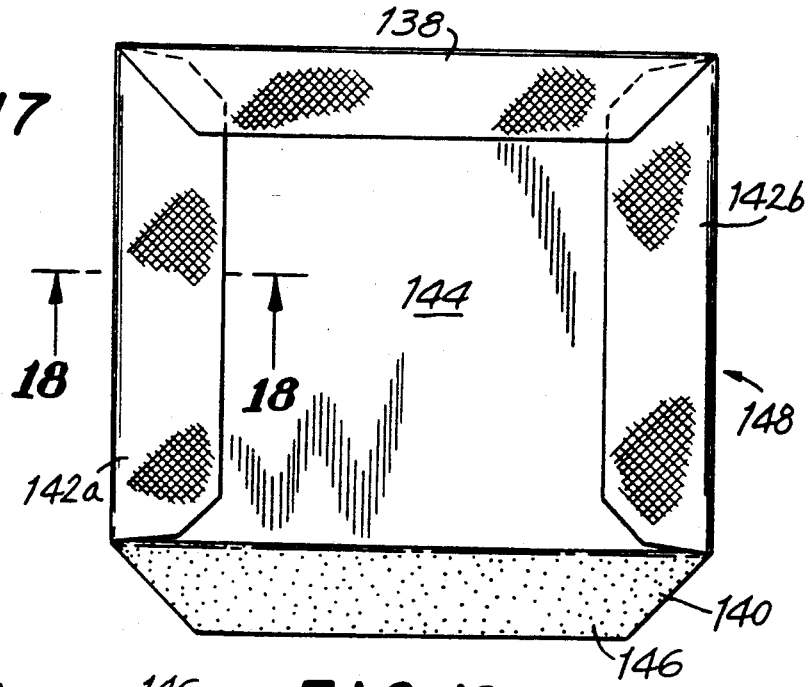
FIG. 17 is a plan view showing a step in the manufacture of a card from the pattern of FIG. 16.
Figure 18:
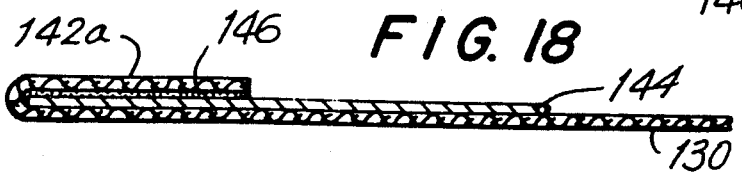
FIG. 18 is a section view taken along line 18—18 of FIG. 17.

A rectangular stiffener element 144 comprising a planar piece of card material having substantially the same peripheral shape as the textile panel 130 is positioned over panel 130 as best seen in FIG. 17. Side flaps 142*a* and 142*b* are folded over respective edges of the stiffener element 144 and affixed to corresponding peripheral regions of the stiffener element, such as by glue 146. The top and bottom flaps 138 and 140 are then similarly folded over the top and bottom edges of the stiffener element 144 and affixed to corresponding peripheral regions thereof. As discussed below, the textile panel affixed to the stiffener element comprises a sub-assembly 148 utilized in the construction of several embodiments of note cards in accordance with the invention.

Figure 19A:
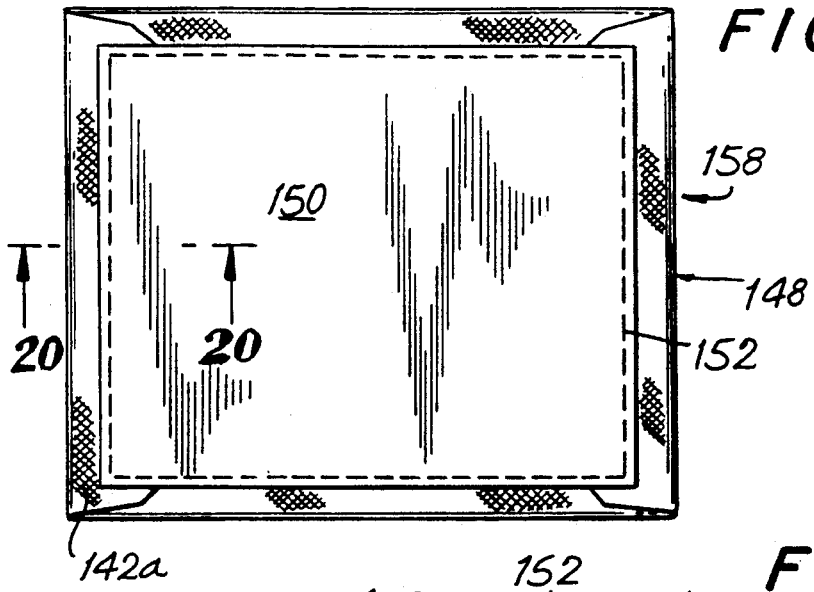
FIG. 19*a* is a plan view of one embodiment of a completed textile card in accordance with the invention, formed from the sequence of steps shown in FIGS. 16–18.
Figure 20:
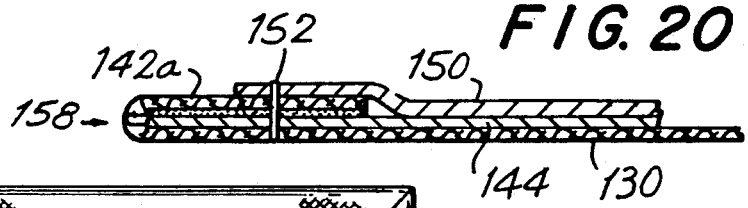
FIG. 20 is a section view taken along line 20—20 of FIG. 19*a;*

More particularly, referring to FIG. 19*a*, a rectangular paper sheet 150 is connected to sub-assembly 148 and provides a surface on which indicia may be printed, e.g. a writing surface. The paper sheet 150 has a substantially rectangular configuration and is connected to the sub-assembly 148 by means of stitching 152. The peripheral edge regions of the paper sheet 150 overlie the folded flaps 138, 140, 142 so that the stitching 152 interconnects the paper sheet 150, the textile panel 144 and respective flaps, and the stiffener element 144, as best seen in FIG. 20.

The embodiment illustrated in FIG. 19*b* is similar in construction to that of FIG. 19*a* except the length dimension of the rectangular card 158' is increased relative to its width, and the card is folded along a fold line FL. The card 158' thus has a booklet configuration, and may be opened and closed as is conventional.

Figure 21:
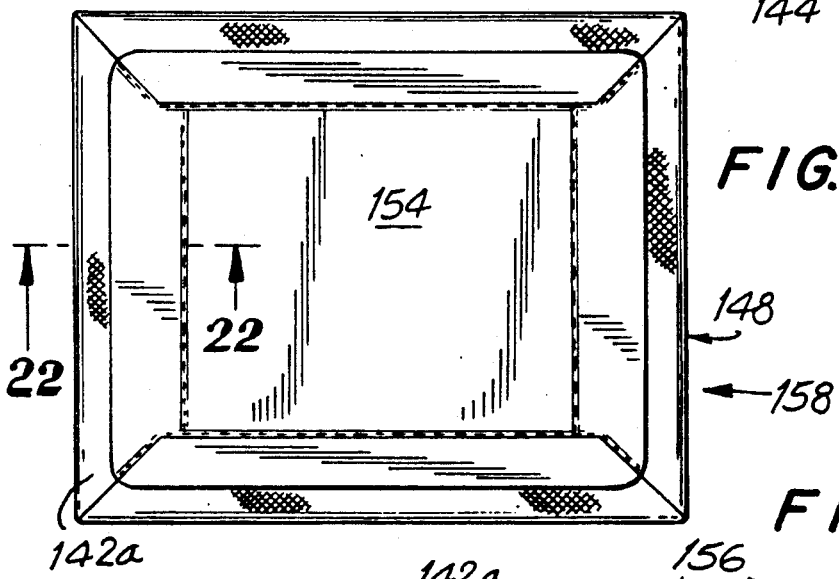
FIG. 21 is a plan view of a second embodiment of a completed textile card in accordance with the invention, formed from the sequence of steps shown in FIGS. 16–18.
Figure 22:
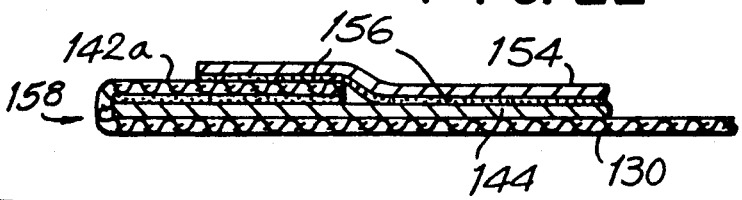
FIG. 22 is a section view taken along line 22—22 of FIG. 21.

In another embodiment shown in FIGS. 21 and 22, a paper sheet 154 is connected to the sub-assembly 148 by means of adhesive 156 (FIG. 22). As in the case of the embodiment of FIG. 19*a*, the top, bottom, and side regions of the paper sheet 154 overlap and are affixed to the folded top, bottom and side flaps as well as to the stiffener element 144.

Figure 23:
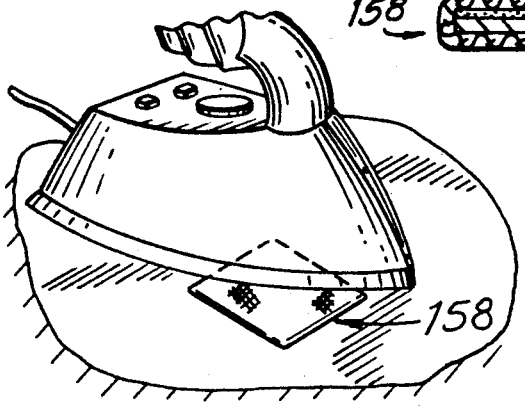
FIG. 23 is a perspective view of a pressing step in the method of manufacture of a textile card in accordance with the invention.

After construction in the manner described above, the completed card 158 is placed on a flat surface and ironed as shown in FIG. 23, on both sides. As noted above, this application of heat and pressure causes the adhesive material to fuse between the fibers of the textile material.

In still another embodiment of a card in accordance with the invention illustrated in FIG. 24, a paper panel 200 is joined to one edge 202 of the paper sheet 204 affixed to the sub-assembly 148 to form a booklet-type card 206. The lower edges 208 and 209 of paper sheet 204 and panel 200 are preferably colinear with the lower edge of subassembly 148. The edge 202 of sheet 204 thus comprises a fold line so that the panel can be folded against the sheet in a booklet fashion. The paper panel 200 and sheet 204 preferably comprise parts of a unitary sheet of paper with the edge 202 comprising a fold line at which the panel 200 is folded to form a booklet-type card.

Referring to FIG. 25, a textile envelope 160 of the type described above and illustrated in FIG. 7*a*, is attached to a gift box 164 by means of transfer tape 166 provided on the back panel below the closed sealing flap. Envelope 160 is provided with a label 168 on which indicia may be printed, such as the address of the recipient of the box.

A textile card 170 of the type shown in FIG. 19*a* is shown in FIG. 26 as being inserted into a textile envelope 172 of the type shown in FIG. 7*a*. The textile material of which the card and envelope are made are preferably the same, or matching, to provide an aesthetic effect not possible using conventional paper cards and envelopes.

Obviously, numerous modifications and variations of the present invention are possible in the light of the above teachings. It is therefore to be understood that within the scope of the claims appended hereto, the invention may be practiced otherwise than as specifically disclosed herein.

I claim:

1. A textile envelope, comprising:

front and back panels formed of textile material having substantially the same peripheral shape as each other, said front and back textile panels having respective peripheral edge regions in opposed relationship with, and connected to, each other;

a sealing flap formed of textile material joined to a peripheral edge of said front panel, and defining a closure for an open end of said envelope;

means situated between, and affixed to at least one of, said front and back textile panels for stiffening at least one of said textile panels, said means comprising a substantially planar, self-supporting device having a peripheral shape substantially the same as said peripheral shape of said front and back textile panels;

each of said back textile panel an stiffener device having a top region, and wherein said top region of said back textile panel is connected to said top region of said stiffener device; and a tuck flap formed of textile material joined to a top edge of said back textile panel, said tuck flap being folded over a top edge of said stiffener device and connected to said top region thereof.

2. A textile envelope as recited in claim 1, wherein said peripheral shape of said front and back textile panels is substantially quadrilateral.

3. A textile envelope as recited in claim 2, wherein said peripheral shape of said front and back textile panels is substantially rectangular.

4. A textile envelope as recited in claim 1, wherein each of said front and back textile panels and said self-supporting stiffener device situated therebetween, has a pair of lateral side regions, each of said stiffener device side regions being situated between side regions of said front and back textile panels, and wherein each of said stiffener device side regions is connected to at least one of said textile panel side regions between which it is situated.

5. A textile envelope as recited in claim 4, wherein each of said self-supporting stiffener device side regions is connected to both of said front and back textile panel side regions between which it is situated.

6. A textile envelope as recited in claim 4, further including a pair of first flaps formed of textile material joined to respective side edges of said front textile panel, said first flaps being folded over and affixed to said side regions of said self-supporting stiffener device.

7. A textile envelope as recited in claim 1, wherein said front and back textile panels, and said sealing flap, and said tuck flap, are formed as parts of a unitary piece of textile material.

8. A textile envelope as recited in claim 1, wherein said textile material comprises a knitted or woven fabric of natural fibers.

9. A textile envelope as recited in claim 1, wherein said textile material comprises a fabric woven or knitted of man-made fiber.

10. A textile envelope as recited in claim 1, further including adhesive means for releasibly affixing said sealing flap to said back textile panel to close an open end of said envelope.

11. A textile envelope as recited in claim 1, wherein said planar self-supporting stiffener device comprises a planar piece of card material.

12. A textile envelope as recited in claim 11, wherein said card material comprising said stiffener device is constituted by recycled paper.

13. A textile envelope as recited in claim 1, wherein said self-supporting planar stiffener device comprises an envelope formed of paper material.

14. A textile envelope, comprising:

a front panel formed of textile material having top, bottom and side edges and peripheral edge regions corresponding thereto;

a back panel formed of textile material having top, bottom and side edges and peripheral edge regions corresponding thereto, said front and back textile panels joined at said bottom edges thereof;

a sealing flap formed of textile material joined to said top edge of said front panel;

means connected to said front and back panels for stiffening said panels and for providing a surface for indicia, said stiffening and indicia surface-providing means comprising a substantially planar, self-supporting stiffener device and including a first panel formed of paper material connected to said front textile panel, and a second panel formed of paper material connected to said back textile panel, said first and second paper panels functioning both to stiffen said textile panels and to provide a surface for indicia; and wherein first side flaps of textile material joined to said side edges of said front textile panel are folded to overlie side regions of said first paper panel, second side flaps of textile material joined to said side edges of said back textile panel are folded to overlie side regions of said second paper panel, and a bottom flap of textile material joined to said top edge of said back textile panel folded to overlie a bottom edge of said second paper panel.

15. A textile envelope as recited in claim 14, wherein said first and second paper panels constitute parts of a unitary sheet of paper material.

16. A textile envelope as recited in claim 15, wherein said self-supporting stiffener device further comprise a third panel formed of paper material connected to said textile sealing flap, said third paper panel constituting a part of said unitary sheet of paper material.

17. A textile envelope as recited in claim 14, wherein each of said first and second side flaps and said bottom flap is stitched to a respective peripheral edge region of said paper and textile panels over which it is folded.

* * * * *